US008300003B2

(12) United States Patent
Park

(10) Patent No.: US 8,300,003 B2
(45) Date of Patent: Oct. 30, 2012

(54) DRIVER FOR REDUCING A NOISE, DISPLAY DEVICE HAVING THE DRIVER, AND METHOD THEREOF

(75) Inventor: Dong-Uk Park, Yongin-si (KR)

(73) Assignee: Samsung Electronics Co., Ltd., Gyeonggi-do (KR)

( * ) Notice: Subject to any disclaimer, the term of this patent is extended or adjusted under 35 U.S.C. 154(b) by 860 days.

(21) Appl. No.: 12/073,684

(22) Filed: Mar. 7, 2008

(65) Prior Publication Data

US 2008/0225029 A1 Sep. 18, 2008

(30) Foreign Application Priority Data

Mar. 14, 2007 (KR) ..... 10-2007-0024954

(51) Int. Cl.
*G09G 3/36* (2006.01)

(52) U.S. Cl. ..... 345/99

(58) Field of Classification Search ..... 345/98–101; 327/295

See application file for complete search history.

(56) References Cited

U.S. PATENT DOCUMENTS 5,867,046 A * 2/1999 Sugasawa ..... 327/258
6,097,234 A * 8/2000 Yeo ..... 327/295
6,137,336 A * 10/2000 Baba et al. ..... 327/295
6,577,167 B1 * 6/2003 Soda ..... 327/91
6,621,480 B1 * 9/2003 Morita ..... 345/99
2001/0022571 A1 * 9/2001 Nakano et al. ..... 345/98
2007/0132698 A1 * 6/2007 Yamashita et al. ..... 345/98
2007/0273632 A1 * 11/2007 Kishimoto et al. ..... 345/98

FOREIGN PATENT DOCUMENTS

JP 11-103244 4/1999
JP 2006-085118 3/2006
KR 10-1999-0081786 11/1999
KR 10-0497000 6/2005

OTHER PUBLICATIONS

Korean Office Action issued Dec. 18, 2007 for KR 2007-0024954.

* cited by examiner

*Primary Examiner* — Chanh Nguyen
*Assistant Examiner* — Roy Rabindranath
(74) *Attorney, Agent, or Firm* — Harness, Dickey & Pierce, P.L.C.

(57) ABSTRACT

A driver may include a plurality of data output units and/or a multi-phase clock generator. The plurality of data output units may be configured to output data based on a plurality of clock signals. The multi-phase clock generator may be configured to receive a master clock signal to generate the plurality of clock signals having different phases in a period of the master clock signal and/or to provide the clock signals to the data output units. A number of the clock signals may correspond to a number of the data output units.

9 Claims, 8 Drawing Sheets

DRIVER FOR REDUCING A NOISE, DISPLAY DEVICE HAVING THE DRIVER, AND METHOD THEREOF

PRIORITY STATEMENT

This application claims the benefit of priority under 35 USC §119 to Korean Patent Application No. 10-2007-0024954, filed on Mar. 14, 2007 in the Korean Intellectual Property Office (KIPO), the entire contents of which are incorporated herein in their entirety by reference.

BACKGROUND

1. Field

Example embodiments relate to noise reduction in a driver, and for example, to a driver for reducing a simultaneous switching noise, which is generated if data are concurrently transmitted, a display device having the driver, and/or a method thereof.

2. Description of Related Art

A noise, e.g., an electromagnetic interference (EMI), may be increased as a number of data concurrently output from a driver is increased.

FIG. 1 is an example timing diagram illustrating clocks generated if a source driver of a conventional display device outputs one line of a video image.

Referring to FIG. 1, the source driver receives a master clock 610 having a period of T, generates clocks 120*a*, 120*b*, and 120*c*, and outputs one line of the video image using the clocks 120*a*, 120*b*, and 120*c*. The clocks 120*a*, 120*b*, and 120*c* may correspond to output groups Group 1, Group 2, . . . , and Group 8 of the conventional display device. Alternatively, the source driver may receive the master clock 610 having the period of T, and may output one line of the video image based on the master clock 610 without using the clocks 120*a*, 120*b*, and 120*c*.

Because a source driver (e.g. a data driver) used in a flat display device concurrently outputs data corresponding to one line of the flat display device based on a control signal, an EMI generated by the source driver is increased as a size of the flat display device is increased.

The international standard for an allowed EMI is relatively strict because EMI has a negative influence on a human body. For example, according to the international special committee on radio interference (CISPR) 22 standard, a level of EMI should be measured at a distance of about three meters from a display device. The level of the EMI should be less than 40 dB in a frequency band of 30~238 MHz. The level of the EMI should be less than 49.8 dB in a frequency band of 238~1000 MHz.

EMI may be increased as the number of data concurrently output from a driver is increased. A simultaneous switching noise (SSN) may distort output waveforms between interfaces thereby reducing proper data transmissions in data sampling.

SUMMARY

Example embodiments provide a driver configured to reduce a noise generated if data are concurrently transmitted.

Example embodiments provide a display device having a driver configured to reduce a noise generated if data are concurrently transmitted.

Example embodiments provide a method of driving data configured to reduce a noise generated if data are concurrently transmitted.

According to an example embodiment, a driver may include a plurality of data output units and/or a multi-phase clock generator. The plurality of data output units may be configured to output data based on a plurality of clock signals. The multi-phase clock generator may be configured to receive a master clock signal to generate the clock signals having different phases in a period of the master clock signal and to provide the clock signals to the data output units. A number of the clock signals may correspond to a number of the data output units.

According to an example embodiment, a display device may include a display panel, a gate driver, a source driver, and/or a timing controller. The display panel may include a plurality of pixels coupled to a plurality of gate lines and a plurality of data lines. The gate driver may be configured to drive the gate lines. The source driver may be configured to drive the data lines. The timing controller may be configured to control the gate driver and the source driver. The source driver may include a driver including a plurality of data output units and/or a multi-phase clock generator. The plurality of data output units may be configured to output data based on a plurality of clock signals. The multi-phase clock generator may be configured to receive a master clock signal to generate the clock signals having different phases in a period of the master clock signal and to provide the clock signals to the data output units. A number of the clock signals may correspond to a number of the data output units.

According to an example embodiment, a method may include receiving a master clock signal, generating a plurality of clocks having different phases in a period of the master clock signal, providing the clocks to a plurality of data output units as a plurality of clock signals; and/or outputting data from the data output units based on the plurality of clock signals.

According to an example embodiment, the multi-phase clock generator may be configured to provide the clock signals to the data output units based on a delta value, the delta value indicating an interval between data output timing points of adjacent data output units.

According to an example embodiment, the multi-phase clock generator may be configured to provide a second clock signal of the plurality of clock signals to an (i+delta value)th data output unit if the number of the data output units is N and a first clock signal of the plurality of clock signals is provided to an (i)th data output unit. The clock signals including the first clock signal and the second clock signal may be sequentially generated.

According to an example embodiment, the multi-phase clock generator may be configured to provide the second clock signal to a data output unit corresponding to a remainder of (i+delta value) divided by N if the (i+delta value) is larger than N.

According to an example embodiment, the delta value may be a value that maximizes the interval to reduce a noise generated if the adjacent data output units output the data.

According to an example embodiment, the multi-phase clock generator may be configured to add a weight value to the delta value if a data output unit that receives one of the clock signals would receive another of the clock signals in a same period of the master clock signal.

According to an example embodiment, the data output units may be divided into M groups and the multi-phase clock generator may provide the clock signals to the M groups.

According to an example embodiment, the multi-phase clock generator may be configured to provide a second clock signal of the plurality of clock signals to an (i+1)th group if a first clock signal of the plurality of clock signals is provided to an (i)th group. The clock signals including the first clock signal and the second clock signal may be sequentially generated.

According to an example embodiment, each of the M groups may have a different bus, and/or each of the data output units in each group shares a same bus.

According to an example embodiment, the multi-phase clock generator may include one of a phase locked loop and a delay locked loop.

BRIEF DESCRIPTION OF THE DRAWINGS

The above and/or other aspects and advantages will become more apparent and more readily appreciated from the following detailed description of example embodiments taken in conjunction with the accompanying drawings of which.

DETAILED DESCRIPTION OF EXAMPLE EMBODIMENTS

Figure 1:
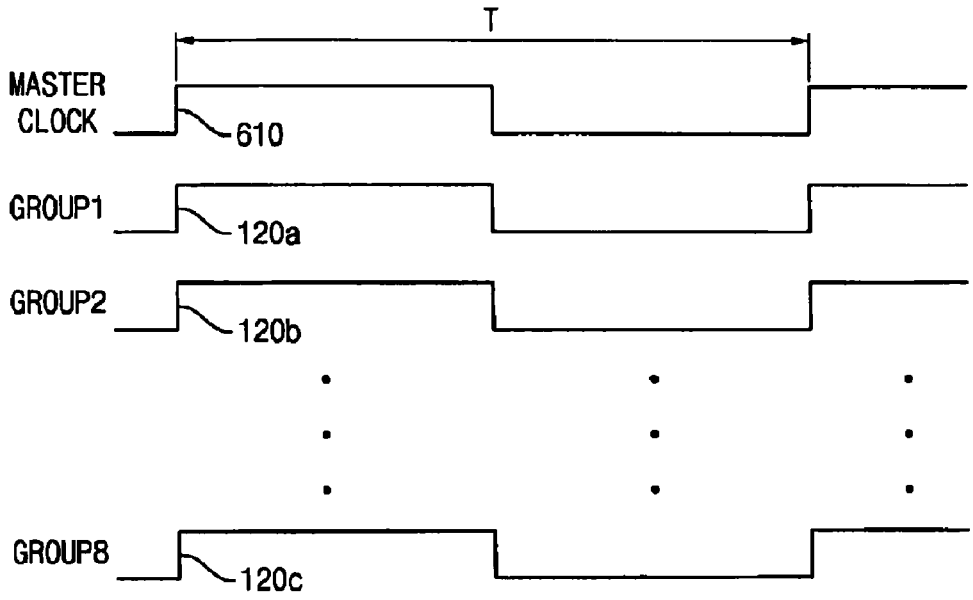
FIG.1 (CONVENTIONAL ART)
FIG. 1 is an example timing diagram illustrating clocks generated if a source driver of a conventional display device outputs one line of a video image.

Example embodiments will now be described more fully hereinafter with reference to the accompanying drawings. Embodiments may, however, be in many different forms and should not be construed as being limited to the example embodiments set forth herein. Rather, these example embodiments are provided so that this disclosure will be thorough and complete, and will fully convey the scope to those skilled in the art. In the drawings, the thicknesses of layers and regions may be exaggerated for clarity.

It will be understood that when a component is referred to as being "on," "connected to" or "coupled to" another component, it can be directly on, connected to or coupled to the other component or intervening components may be present. In contrast, when a component is referred to as being "directly on," "directly connected to" or "directly coupled to" another component, there are no intervening components present. As used herein, the term "and/or" includes any and all combinations of one or more of the associated listed items.

It will be understood that, although the terms first, second, third, etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the example embodiments.

Spatially relative terms, such as "beneath," "below," "lower," "above," "upper" and the like, may be used herein for ease of description to describe one component or feature's relationship to another component(s) or feature(s) as illustrated in the drawings. It will be understood that the spatially relative terms are intended to encompass different orientations of the device in use or operation in addition to the orientation depicted in the figures.

The terminology used herein is for the purpose of describing particular example embodiments only and is not intended to be limiting. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, and/or components.

Unless otherwise defined, all terms (including technical and scientific terms) used herein have the same meaning as commonly understood by one of ordinary skill in the art to which example embodiments belong. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Reference will now be made to example embodiments, which are illustrated in the accompanying drawings, wherein like reference numerals refer to the like components throughout.

Figure 2:
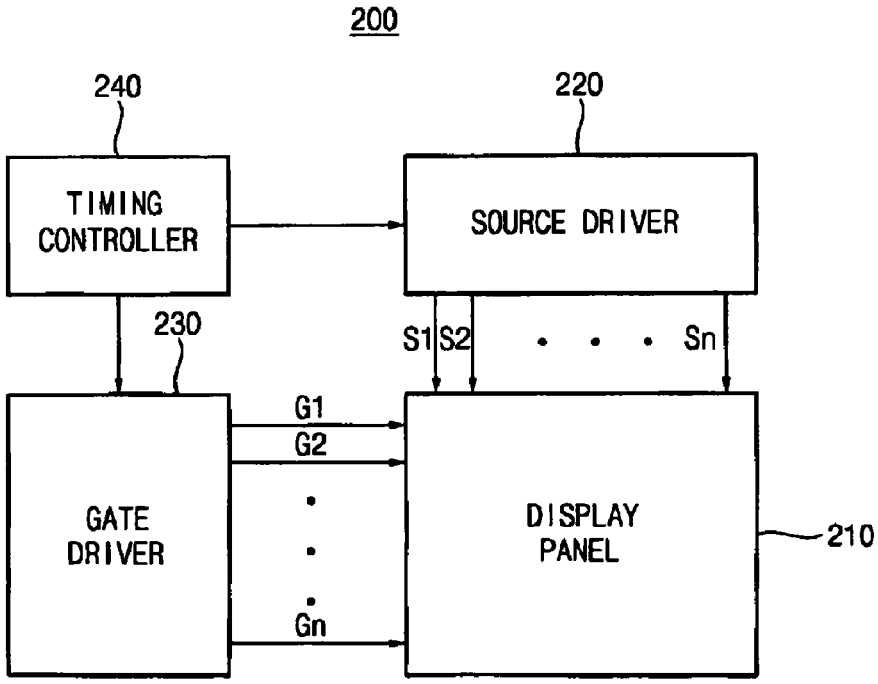
FIG. 2 is a block diagram illustrating a display device according to an example embodiment.

FIG. 2 is a block diagram illustrating a display device according to an example embodiment.

Referring to FIG. 2, the display device 200 may include a display panel 210, a source driver 220, a gate driver 230, and/or a timing controller 240.

The display panel 210 may include a plurality of pixels coupled to a plurality of gate lines G1-Gn and a plurality of data lines S1-Sn for displaying a video image or a still image.

The source driver 220 may drive the data lines S1-Sn of the display panel 210. For example, the source driver 220 may provide one line of the video image or one line of the still image to the display panel 210.

The gate driver 230 may drive the gate lines G1-Gn of the display panel 210. For example, the gate driver 230 may display the one line provided by the source driver 220 by selecting a gate line (e.g. a row of a display) among the gate lines G1-Gn (e.g. the rows of the display).

The timing controller 240 may control the source driver 220 and the gate driver 230. For example, the timing controller 240 may control an operation timing of the source driver 220 and the gate driver 230.

Figure 3:
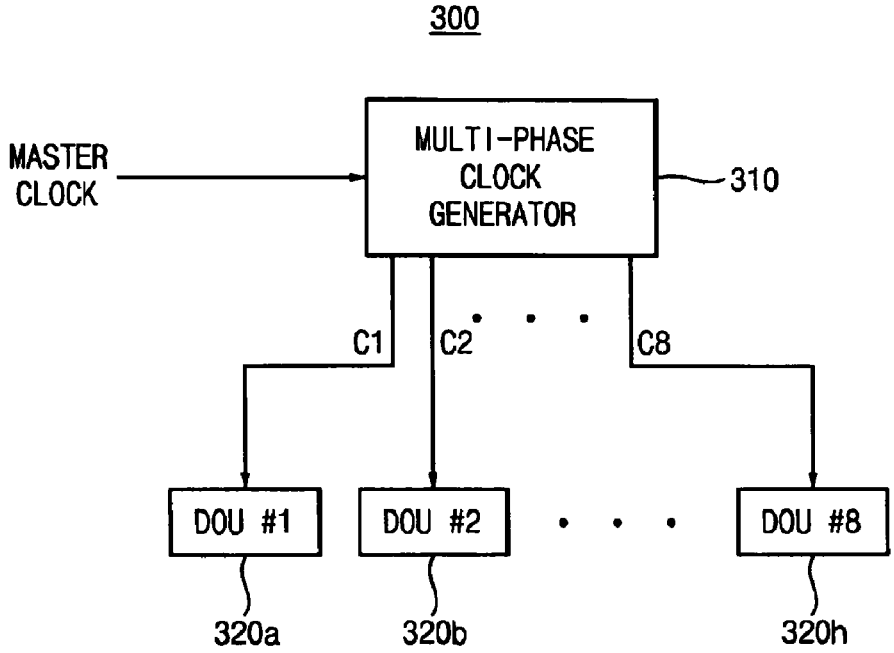
FIG. 3 is a block diagram illustrating a source driver according to an example embodiment.

FIG. 3 is a block diagram illustrating a source driver according to an example embodiment.

Referring to FIG. 3, the source driver 300 may include a multi-phase clock generator 310 and/or first through eighth data output units 320*a* through 320*h*.

Each of the first through eighth data output units 320*a* through 320*h* may be coupled to the multi-phase clock generator 310 via an independent channel (e.g. a bus), and output data based on clock signals. For example, the first through eighth data output units 320*a* through 320*h* may be column drivers configured to respectively output at least one column data of one line of an image provided to the source driver 300.

The multi-phase clock generator 310 may receive a master clock signal to generate clocks C1 through C8 (e.g. 8 clocks) having different phases in a period T of the master clock signal. The number of the clocks C1 through C8 may correspond to the number of the first through eighth data output units 320*a* through 320*h*. The multi-phase clock generator 310 may provide the clocks C1 through C8 to the first through eighth data output units 320*a* through 320*h*. For example, each of the data output units 320*a* through 320*h* may output data based on one of the clocks C1 through C8. Accordingly, each one of the clocks C1 through C8 may correspond to one of the data output units 320*a* through 320*h*.

Figure 4:
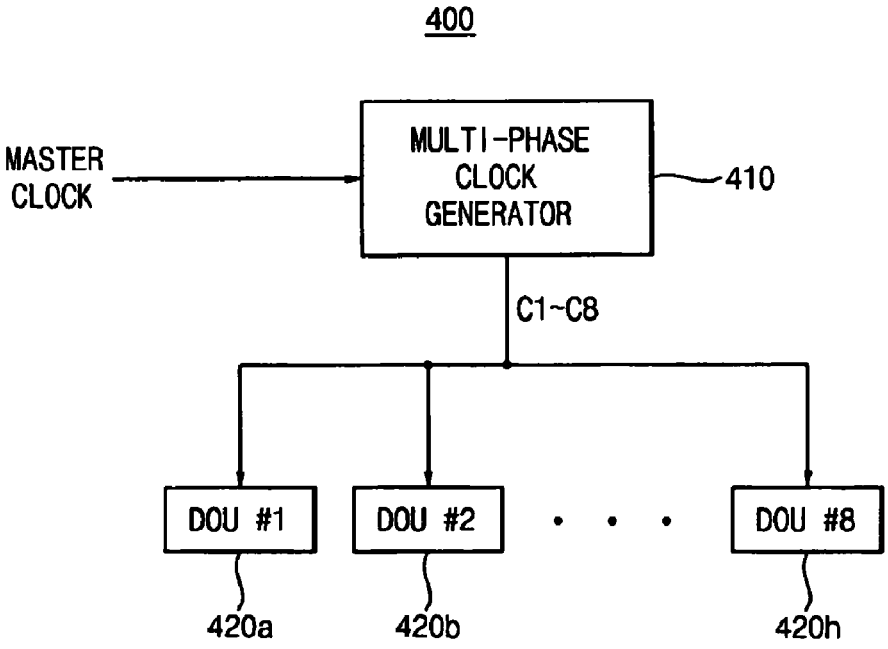
FIG. 4 is a block diagram illustrating a source driver according to another example embodiment.

FIG. 4 is a block diagram illustrating a source driver according to another example embodiment.

Referring to FIG. 4, the source driver 400 may include a multi-phase clock generator 410 and/or first through eighth data output units 420*a* through 420*h*.

The first through eighth data output units 420*a* through 420*h* may share a channel (e.g. a bus) coupled to the multi-phase clock generator 410, and output data based on clock signals. For example, the first through eighth data output units 420*a* through 420*h* may be column drivers configured to respectively output at least one column data of one line of an image provided to the source driver 400.

The multi-phase clock generator 410 may receive a master clock signal to generate clocks C1 through C8 (e.g. 8 clocks) having different phases in a period T of the master clock signal. The number of the clocks C1 through C8 may correspond to the number of the first through eighth data output units 420*a* through 420*h*. The multi-phase clock generator 410 may provide the clocks C1 through C8 to the first through eighth data output units 420*a* through 420*h*. For example, each of the data output units 420*a* through 420*h* may output data based on one of the clocks C1 through C8. Accordingly, each one of the clocks C1 through C8 may correspond to one of the data output units 420*a* through 420*h*.

For example, in order to provide proper clock signals to the first through eighth data output units 420*a* through 420*h*, the multi-phase clock generator 410 may transmit identifiers with the clock signals. The identifiers may respectively identify the first through eighth data output units 420*a* through 420*h*.

Hereinafter, an operation of the source drivers illustrated in FIGS. 3 and 4 will be described referring to FIGS. 5 and 6.

Figure 5:
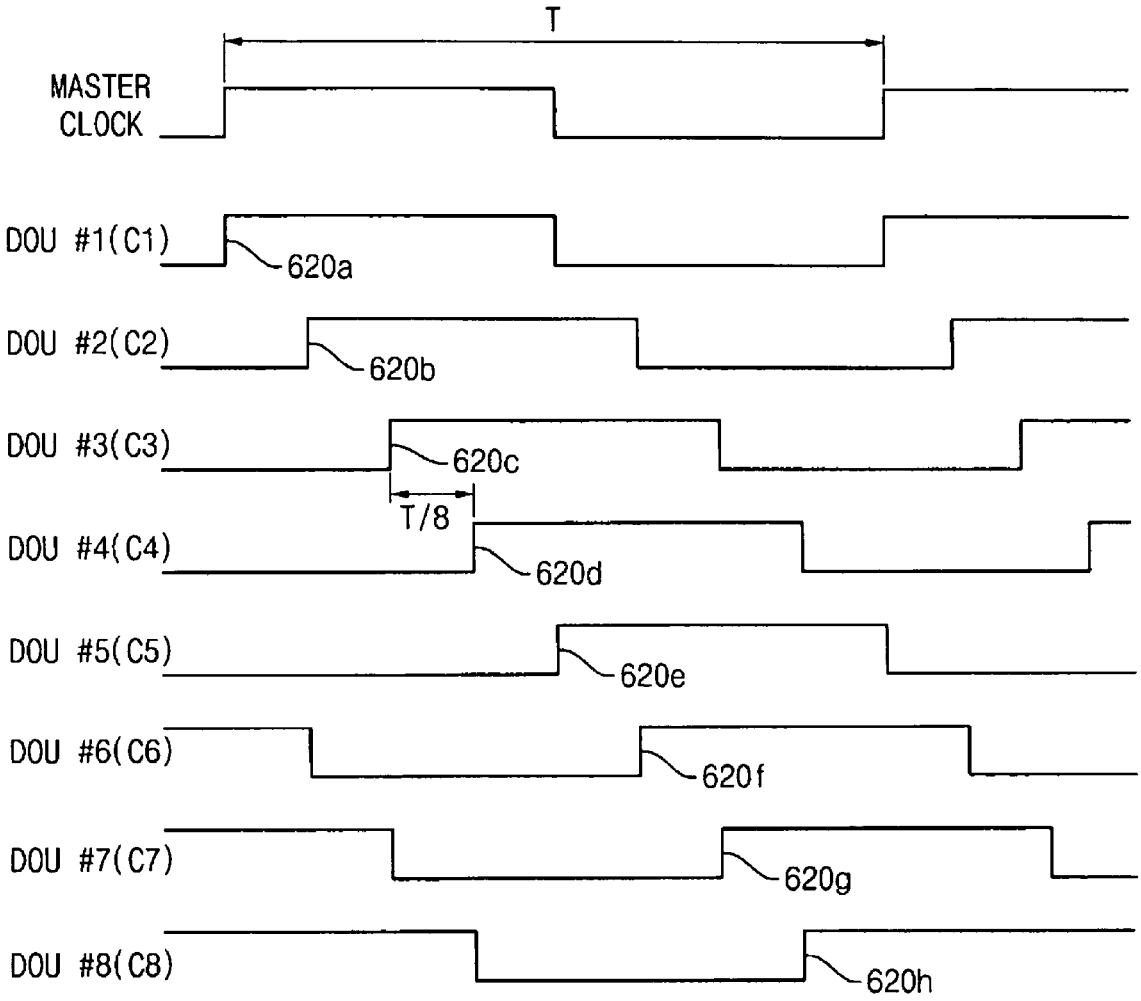
FIG. 5 is an example timing diagram illustrating an example operation of source drivers illustrated in FIGS. 3 and 4.

FIG. 5 is an example timing diagram illustrating an example operation of source drivers of FIGS. 3 and 4.

The multi-phase clock generator 310 or 410 may provide the clocks C1 through C8 to the first through eighth data output units DOU #1 through DOU #8 based on a delta value. The delta value may indicate an interval between data output timing points of the adjacent data output units DOU #1 through DOU #8.

If the delta value corresponds to 1, the clocks C1 through C8 may be sequentially provided to the first through eighth data output units DOU #1 through DOU #8. The first through eighth data output units DOU #1 through DOU #8 may output the data responding to transition points 620*a* through 620*h*, respectively. For example, the transition points 620*a* through 620*h* may respectively correspond to a transition of the clocks C1 through C8 to a higher voltage level.

For example, if the delta value is 1 and the number of data output units is 8, the multi-phase clock generator 310 or 410 may provide a second clock signal (e.g. C2) to a (i+1)th data output unit if a first clock signal (e.g. C1) is provided to a (i)th data output unit.

Figure 6:
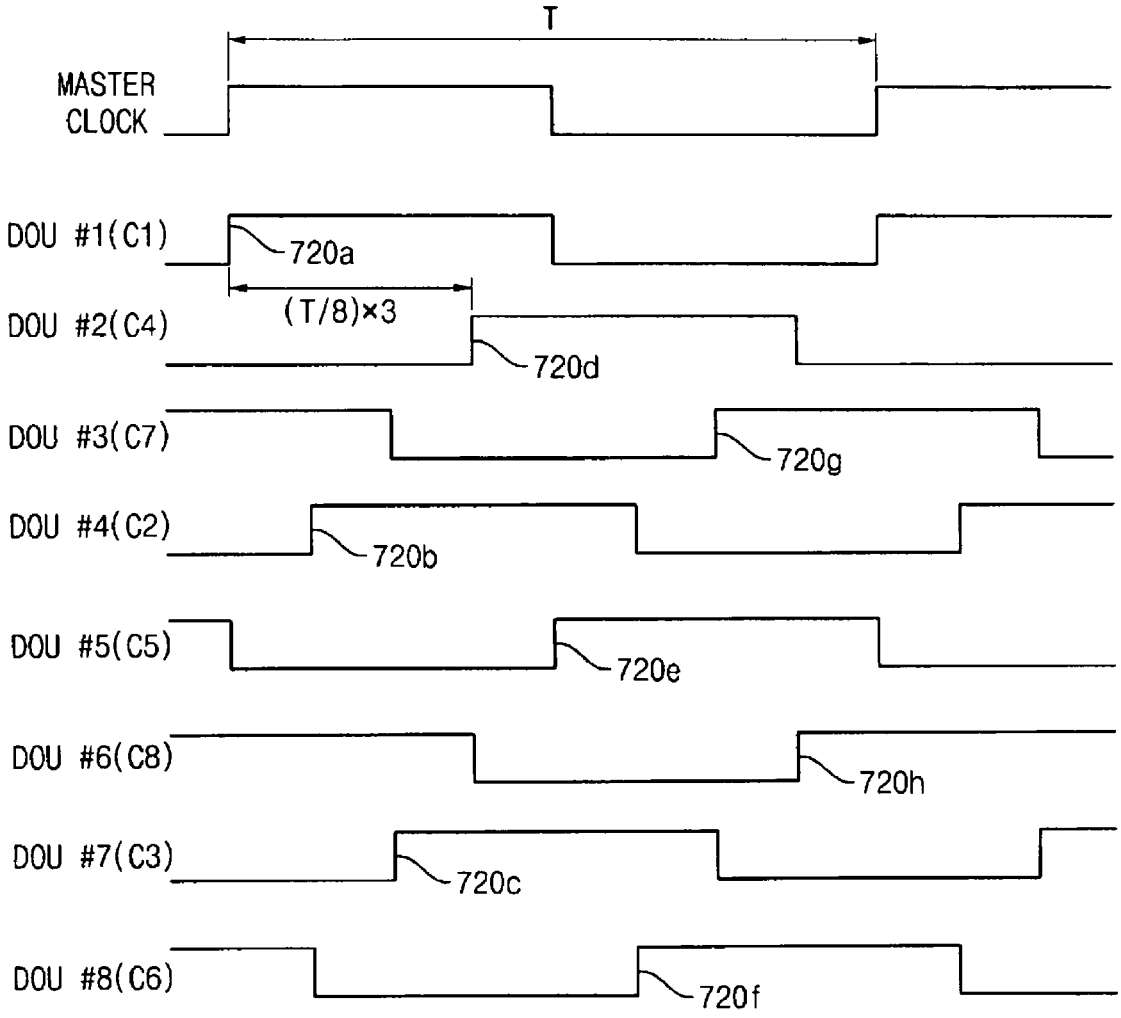
FIG. 6 is an example timing diagram illustrating another example operation of source drivers illustrated in FIGS. 3 and 4.

FIG. 6 is an example timing diagram illustrating another example operation of source drivers illustrated in FIGS. 3 and 4.

The multi-phase clock generator 310 or 410 may provide the clocks C1 through C8 to the first through eighth data output units DOU #1 through DOU #8 based on a delta value. The delta value may indicate an interval between data output timing points of the adjacent data output units DOU #1 through DOU #8.

If the delta value corresponds to 3, the clocks C1 through C8 may be provided with 3 intervals to the first through eighth data output units DOU #1 through DOU #8. The first through eighth data output units DOU #1 through DOU #8 may output the data responding to transition points 720*a* through 720*h*, respectively. For example, a time between data output time points of adjacent data output units may be equal to the period of the master clock signal divided by a number of data output units or clocks and multiplied by the delta value.

For example, if the delta value is 3 and the number of the data output units is 8, the multi-phase clock generator 310 or 410 may provide a second clock signal (e.g. C2) to a (i+3)th data output unit if a first clock signal (e.g. C1) is provided to a (i)th data output unit. For example, the second clock signal (e.g. C2) may be provided to a fourth data output unit DOU #4 if the first clock signal (e.g. C1) is provided to a first data output unit DOU #1.

If the number of data output units is 8 and (i+3) is larger than 8, the multi-phase clock generator 310 or 410 may provide the second clock signal to a data output unit corresponding to a remainder of (i+3) divided by 8. For example, a fourth clock signal (e.g. C4) may be provided to the second data output unit DOU #2 if a third clock signal (e.g. C3) is provided to the seventh data output unit DOU #7.

The delta value may be a value that increases, e.g. maximizes, the interval between the data output timing points of the adjacent data output units to reduce a noise generated if adjacent data output units output the data. If the number of the data output units corresponds to 8, the delta value may correspond to 4. For example, the delta value may be selected to maximize a time interval between a data output timing point of a first data output unit DOU #1 and a data output timing point of a second data output unit DOU #2 and between the data output timing point of the second data output unit DOU #2 and a data output timing point of a third data output unit DOU #3.

The multi-phase clock generator 310 or 410 may add a weight value to the delta value if a data output unit that receives one of the clock signals C1 through C8 would receive another of the clock signals C1 through C8 in a period T of the master clock signal.

For example, if the delta value corresponds to 4 and the number of the data output units corresponds to 8, the first clock signal C1 may be provided to the first data output unit DOU #1, the second clock signal C2 may be provided to the fifth data output unit DOU #5, and/or the third clock signal C3 would be provided to the first data output unit DOU #1 again. Therefore, the delta value may need to be changed so that the third clock signal C3 is not provided to the first data output unit DOU #1 again. The changed delta value may return to the original delta value, e.g., after the third clock signal C3 is provided to a data output unit other than the first data output unit DOU #1 again.

Therefore, the multi-phase clock generator 310 or 410 may provide the third clock signal C3 to the second data output unit DOU #2 by adding the weight value (e.g. 1) to the delta value. The weight value may be a value that increases, e.g., maximizes, the interval between the data output time points of the adjacent data output units.

Figure 7:
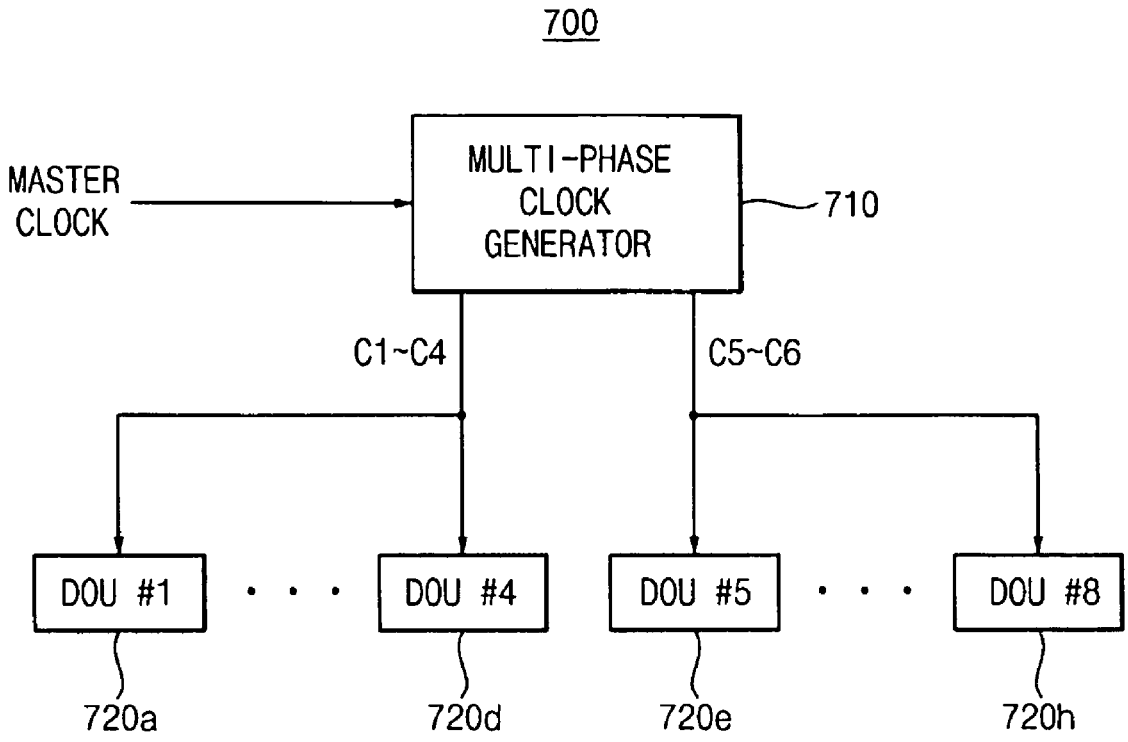
FIG. 7 is a block diagram illustrating a source driver according to still another example embodiment.

FIG. 7 is a block diagram illustrating a source driver according to still another example embodiment.

Referring to FIG. 7, the source driver 700 may include a multi-phase clock generator 710 and/or first through eighth data output units 720*a* through 720*h*.

The first through eighth data output units 720*a* through 720*h* may be divided into M groups, and/or each group may respectively output data based on clock signals. For example, the first through eighth data output units 720*a* through 720*h* may be divided into a first group (e.g. the first group may include the first through fourth data output units 720*a* through 720*d*) and a second group (e.g. the second group may include the fifth through eighth data output units 720*e* through 720*h*). The first through fourth data output units 720*a* through 720*d* included in the first group may share one bus. The fifth through eighth data output units 720*e* through 720*h* included in the second group may share another bus. The first through eighth data output units 720*a* through 720*h* may be column drivers configured to respectively output at least one column data of one line of an image provided to the source driver 700.

The M groups may be implemented separately in different integrated circuits or commonly in one integrated circuit.

The multi-phase clock generator 710 may receive a master clock signal to generate clocks C1 through C8 (e.g. 8 clocks) having different phases in a period T of the master clock signal. The number of the clocks C1 through C8 may correspond to the number of the first through eighth data output units 720*a* through 720*h*. The multi-phase clock generator 710 may provide the clocks C1 through C8 to the first through eighth data output units 720*a* through 720*h* included in the first and second groups. For example, each of the data output units 720*a* through 720*h* may output data based on one of the clocks C1 through C8. Accordingly, each one of the clocks C1 through C8 may correspond to one of the data output units 720*a* through 720*h*.

For example, in order to provide proper clock signals to the first through eighth data output units 720*a* through 720*h*, the multi-phase clock generator 710 may transmit identifiers with the clock signals. The identifiers may identify the data output units (e.g. 720*a* through 720*h*) in the groups.

Hereinafter, an operation of the source driver illustrated in FIG. 7 will be described.

The data output units may be divided into M groups (e.g. 2 groups). The multi-phase clock generator 710 may provide the clocks C1 through C8 to the groups.

If the number of the groups is M and a first clock signal is provided to an (i)th group, the multi-phase clock generator 710 provides a second clock signal to an (i+1)th group. For example, the second clock signal C2 may be provided to a second group if the first clock signal C1 is provided to a first group.

The delta value may be a value that increases, e.g. maximizes, the interval between the data output timing points of the adjacent data output units in each of the groups.

According to an example embodiment, the multi-phase clock generator 710 may control a delta value to respectively provide the clocks C1 through C8 to the groups even though the multi-phase clock generator 710 needs no information about the groups.

The multi-phase clock generators 310, 410 and 710 of FIGS. 3, 4 and 7 may be implemented using a phase locked loop (PLL) or a delay locked loop (DLL).

Figure 8:
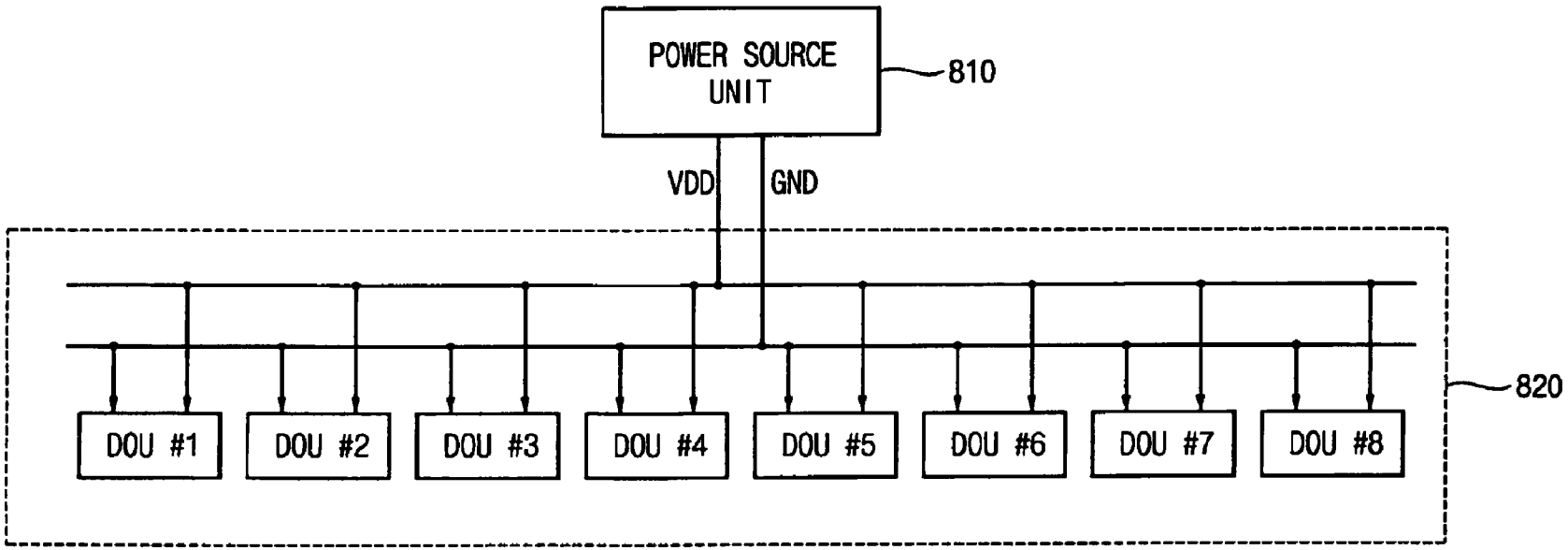
FIG. 8 is a diagram illustrating a power source unit configured to provide a power voltage and a ground voltage to a source driver in a display device illustrated in FIG. 2.

FIG. 8 is a diagram illustrating a power source unit configured to provide a power voltage and a ground voltage to a source driver in a display device illustrated in FIG. 2.

Referring to FIGS. 2 and 8, the display device 200 may include a power source unit 810. The power source unit 810 may provide the power voltage VDD and the ground voltage GND to data output units DOU #1 through DOU #8 in the source driver 820.

FIGS. 9 through 12 illustrate example simulation results of a circuit illustrated in FIG. 8.

Figure 9:
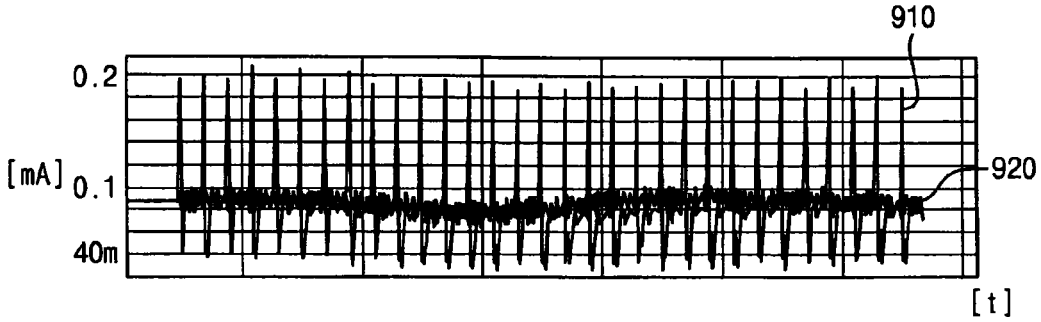
FIG. 9 is an example waveform diagram illustrating a current that flows at a ground voltage node if a method illustrated in FIG. 5 is employed.
Figure 10:
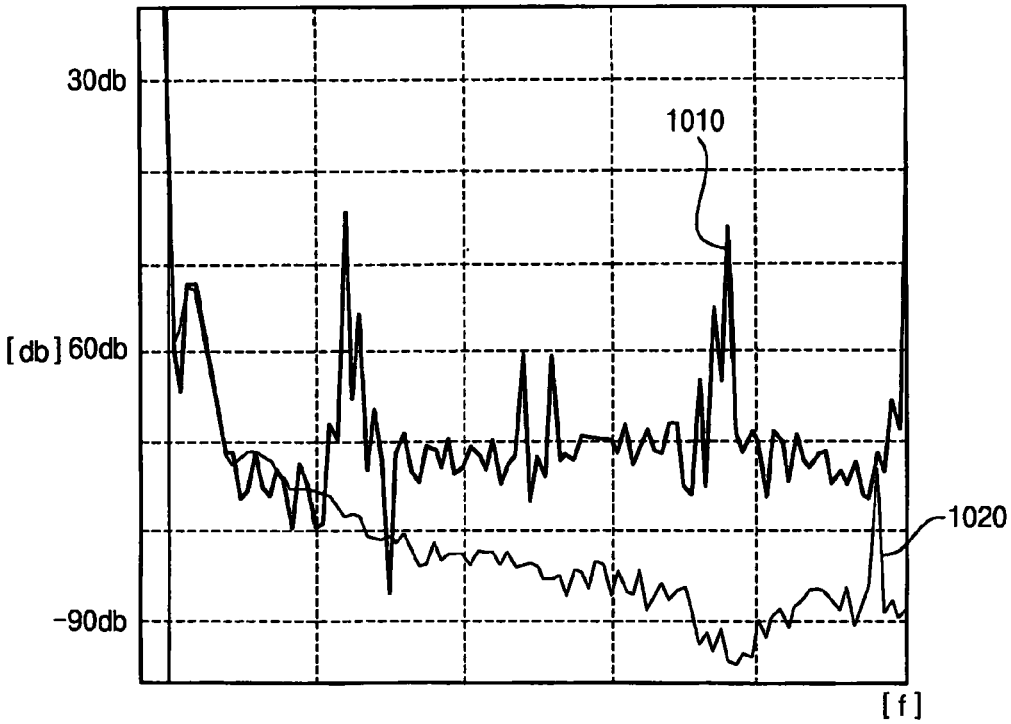
FIG. 10 is an example waveform diagram illustrating a Fourier-transform of the current in FIG. 9.

FIG. 9 is an example waveform diagram illustrating a current that flows at a ground voltage node if a method illustrated in FIG. 5 is employed. FIG. 10 is an example waveform diagram illustrating a Fourier-transform of the current illustrated in FIG. 9.

A first graph 910 indicates an example current that flows at a node or terminal of the ground voltage GND if a conventional method is employed such that a switching operation is concurrently performed. A second graph 920 indicates the current that flows at the ground voltage node if the method illustrated in FIG. 5 is employed. As the first and second graphs 910 and 920 illustrate, a peak of the current that flows at the ground voltage node severely fluctuates if the conventional method is employed. However, noises may be dispersed if the method illustrated in FIG. 5 is employed.

Referring to FIG. 10, a third graph 1010 illustrates a Fourier-transform of the current represented by the first graph 910 and a fourth graph 1020 illustrates a Fourier-transform of the current represented by the second graph 920. The third and fourth graphs 1010 and 1020 illustrate that the noise generated if the method illustrated in FIG. 5 is employed is about 10 dB lower than the noise generated if the conventional method is employed.

Figure 11:
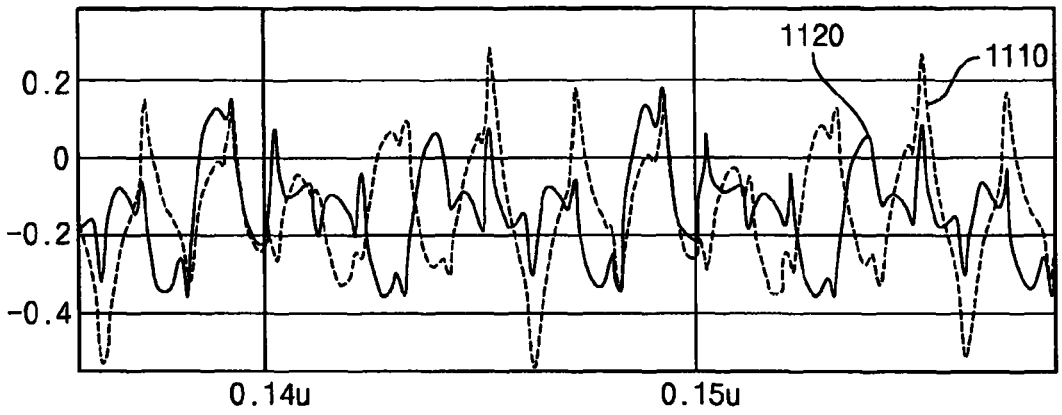
FIG. 11 is an example waveform diagram illustrating a current that flows at a power voltage node if a method illustrated in FIG. 6 is employed.
Figure 12:
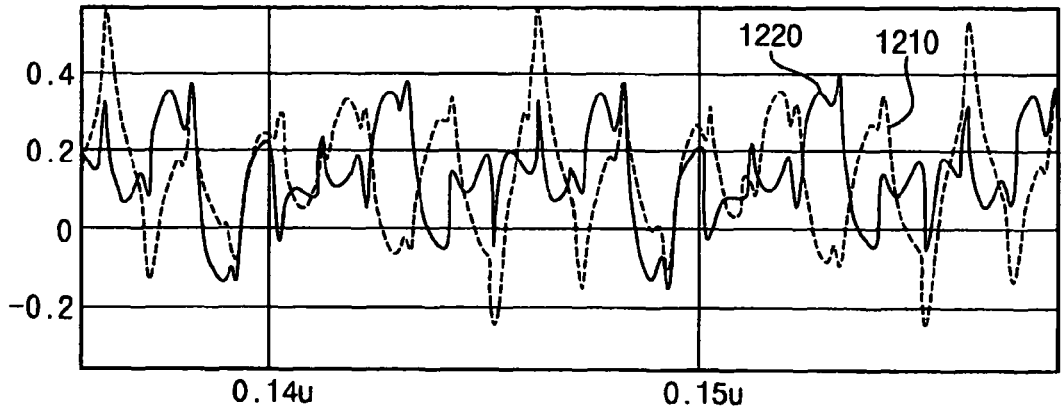
FIG. 12 is an example waveform diagram illustrating a current that flows at a ground voltage node if a method illustrated in FIG. 6 is employed.

FIG. 11 is an example waveform diagram illustrating a current that flows at a power voltage node if a method illustrated in FIG. 6 is employed. FIG. 12 is an example waveform diagram illustrating a current that flows at a ground voltage node if a method illustrated in FIG. 6 is employed.

A fifth graph 1110 indicates the current that flows at a node of the power voltage VDD if the method illustrated in FIG. 5 is employed. A sixth graph 1120 indicates the current that flows at a node of the power voltage VDD if the method illustrated in FIG. 6 is employed.

A seventh graph 1210 indicates the current that flows at the ground voltage node if the method illustrated in FIG. 5 is employed. An eighth graph 1220 indicates the current that flows at the ground voltage node if the method illustrated in FIG. 6 is employed.

Example embodiments are described above in relation eight data output units DOU #1 through DOU #8 and clocks C1 through C8. However, example embodiments are not limited thereto, and example embodiments may include any number of data output units and any number of clocks.

As described above, example embodiments may reduce a noise generated if data are concurrently transmitted (e.g. an electromagnetic interference and/or a simultaneous switching noise) by dispersing timing points for outputting the data.

Although example embodiments have been shown and described in this specification and figures, it would be appreciated by those skilled in the art that changes may be made to the illustrated and/or described example embodiments without departing from their principles and spirit.

What is claimed is:

1. A driver comprising:

a plurality of data output units configured to output data based on a plurality of clock signals, respectively; and a multi-phase clock generator configured to, receive a master clock signal to generate the plurality of clock signals with identifiers, the plurality of clock signals having a same frequency as the master clock signal and different phases in a period of the master clock signal and configured to provide the plurality of clock signals to the respective data output units, the identifiers identifying the plurality of data output units, and provide a second clock signal of the plurality of clock signals to an (i+j)th data output unit if a first clock signal of the plurality of clock signals is provided to an (i)th data output unit, i being a natural number, and j representing a delta value and being a natural number greater than one, wherein a number of the plurality of clock signals corresponds to a number of the plurality of data output units, and the plurality of clock signals including the first clock signal and the second clock signal are immediately adjacent sequentially generated.

2. The driver of claim 1, wherein the plurality of data output units are divided into M groups and the multi-phase clock generator provides the plurality of clock signals to the M groups, wherein M is a natural number.

3. The driver of claim 2, wherein each of the M groups has a different bus, and each of the plurality of data output units in each group shares a same bus.

4. The driver of claim 1, wherein the multi-phase clock generator includes one of a phase locked loop and a delay locked loop.

5. A display device, comprising:

a display panel including a plurality of pixels coupled to a plurality of gate lines and a plurality of data lines;

a gate driver configured to drive the gate lines;

a source driver configured to drive the data lines; and a timing controller configured to control the gate driver and the source driver, wherein the source driver includes the driver of claim 1.

6. The display device of claim 5, wherein the data output units are divided into M groups and the multi-phase clock generator is configured to provide the plurality of clock signals to the M groups, wherein M is a natural number.

7. The display device of claim 6, wherein each of the M groups has a different bus, and each of the plurality of data output units in each group shares a same bus.

8. The display device of claim 5, wherein the multi-phase clock generator includes one of a phase locked loop and a delay locked loop.

9. A method comprising: receiving a master clock signal;

generating a plurality of clocks having a same frequency as the master clock signal and different phases in a period of the master clock signal;

providing the plurality of clocks to a respective plurality of data output units as a plurality of clock signals with identifiers, a number of the plurality of clock signals corresponding to a number of the plurality of data output units the identifiers identifying the plurality of data output units, the providing including providing a second clock signal of the plurality of clock signals to an (i+j)th data output unit if a first clock signal of the plurality of clock signals is provided to an $(i)^{th}$ data output unit, i being a natural number, and i representing a delta value and being a natural number greater than one; and outputting data from the plurality of data output units based on the respective plurality of clock signals, wherein the plurality of clock signals including the first clock signal and the second clock signal are immediately adjacent sequentially generated.

* * * * *